US005385316A

United States Patent [19]

Weis

[11] Patent Number: 5,385,316

[45] Date of Patent: Jan. 31, 1995

[54] SPLICING APPARATUS FOR PAPER PLANT

[75] Inventor: Manfred Weis, Dusseldorf, Germany

[73] Assignee: Jagenberg Aktiengesellshaft, Dusseldorf, Germany

[21] Appl. No.: 90,424

[22] Filed: Jul. 12, 1993

[30] Foreign Application Priority Data

Jul. 11, 1992 [DE] Germany ..... 4222880

[51] Int. Cl.[6] ..... B65H 19/18

[52] U.S. Cl. ..... 242/552; 242/556.1; 156/502

[58] Field of Search ..... 242/551, 552, 556, 556.1; 156/502, 507, 157

[56] References Cited

U.S. PATENT DOCUMENTS 4,681,274 7/1987 Thievessen et al. ..... 242/552
5,169,082 12/1992 da Silva et al. ..... 242/551
5,288,034 2/1994 Schonmeier et al. ..... 242/552

FOREIGN PATENT DOCUMENTS 2118984 7/1976 Germany .
344017 11/1988 Germany .
3907136 9/1990 Germany .

*Primary Examiner*—Daniel P. Stodola
*Assistant Examiner*—John Q. Nguyen
*Attorney, Agent, or Firm*—Herbert Dubno; Andrew Wilford

[57] ABSTRACT

A splicing apparatus has a drum rotatable about a drum axis adjacent a web roll and having a generally cylindrical outer surface centered on the drum axis. A pair of suction bars on the drum defining thereon an axially extending and radially outwardly open slot each have an outer surface and are each pivotal about an axis generally parallel to the drum axis between a rest position with the bar surface forming a respective part or continuation of the outer surface of the drum and a holding position with its surface pressed angularly against the other bar so that in the holding position a web end can be clamped between the bars. Air is aspirated through the surfaces of the bars to adhere the web to the drum. The drum can be rotated about the drum axis and can be moved to displace the drum into engagement with the web.

5 Claims, 6 Drawing Sheets

SPLICING APPARATUS FOR PAPER PLANT

FIELD OF THE INVENTION

The present invention relates to a splicing apparatus. More particularly this invention concerns such an apparatus used to join the trailing end of a depleted roll of paper to the leading end of a full new roll.

BACKGROUND OF THE INVENTION

It is standard in a paper plant to unroll huge rolls of paper, often up to 8 m long and weighing as much as 50 ton, then Longitudinally slit the paper and roll it up into individual smaller rolls. To this end the starting rolls that are carried on heavy steel shafts are unwound in an unwinding station at high rates of speed and fed through various slitters to a winding station.

As described in WO 90/10591 of H. Schonmeier et al published Sep. 20, 1990 (see also German 2,118,984 published Nov. 9, 1972 and German 3,440,107 of K. Thievessen published May 22, 1986), a splicing drum movable adjacent the unwinding station has a cylindrical surface that can be engaged against the paper web as it moves away from the paper roll. The splicing drum has an axially extending and radially outwardly open groove in which is provided a cutter and which is flanked by a pair of suction regions. Thus, when this splicing drum is pressed against the web, one of the suction regions can be activated to hold the web against the roll surface as the cutter transversely slits across the web. This leaves the trailing edge of the outgoing web suctionally adhered to the splicing-roll surface so that the depleted roll can be replaced with a full fresh roll of paper whose free end is typically provided with an outwardly facing adhesive strip. Then the splicing drum is pressed against and rolled off on the new roll to adhere the trailing end of the now replaced paper roll to the free end of the fresh roll, and the unwinding/winding process is completed.

In order to tension the paper web the splicing drum is provided with a gripper in the cutter slot. This gripper is formed as a cable spanned between a pair of arms that can pinch the suctionally held paper end against one edge of the slot while the splicing drum is rotated to put the desired tension in the web. It is fairly common for a new supply roll to be wound oppositely to the roll being taken out and it is clearly impractical to turn around a huge roll weighing many tons, so the splice arrangement must be able to adapt to takeoff from rolls wound in different directions. Hence the gripper can move against either edge of the slot and the drum can be rotated in either direction.

The main disadvantage of this arrangement is that the web is not held very strongly, so that it can slip out and be dropped by the splicing drum. If enough force is used to clamp it securely, the chance of tearing or cutting the web is great.

OBJECTS OF THE INVENTION

It is therefore an object of the present invention to provide an improved splicing apparatus for a paper plant.

Another object is the provision of such an improved splicing apparatus for a paper plant which overcomes the above-given disadvantages, that is which holds the web end very securely without risking damage to it.

SUMMARY OF THE INVENTION

A splicing apparatus has according to the invention a drum rotatable about a drum axis adjacent a web roll and having a generally cylindrical outer surface centered on the drum axis. A pair of suction bars on the drum defining thereon an axially extending and radially outwardly open slot each have an outer surface and are each pivotal about an axis generally parallel to the drum axis between a rest position with the bar surface forming a respective part or continuation of the outer surface of the drum and a holding position with its surface pressed angularly against the other bar so that in the holding position a web end can be clamped between the bars. Air is aspirated through the surfaces of the bars to adhere the web to the drum. The drum can be rotated about the drum axis and can be displaced into engagement with the web.

Thus with this system the web end is gripped solidly between two rigid elements. Since both bars are built as pivotal suction boxes, it is possible to hold and grip for rotation of the drum in either direction, depending on how the web is being pulled off the supply roll.

In accordance with a further feature of this invention a cutter is displaceable along the slot between the bars for transversely slitting the web engaging the bar surfaces. The drum is provided in the slot with an axially extending guide rail on which the cutter rides. In addition the axes of the bars are closely juxtaposed with the bar outer surface and are substantially offset from the drum axis so that they can describe the above-described pivotal movement without losing suctional grip on the web end. The controller for the apparatus includes a reversible variable-torque drive motor connected to the drum.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
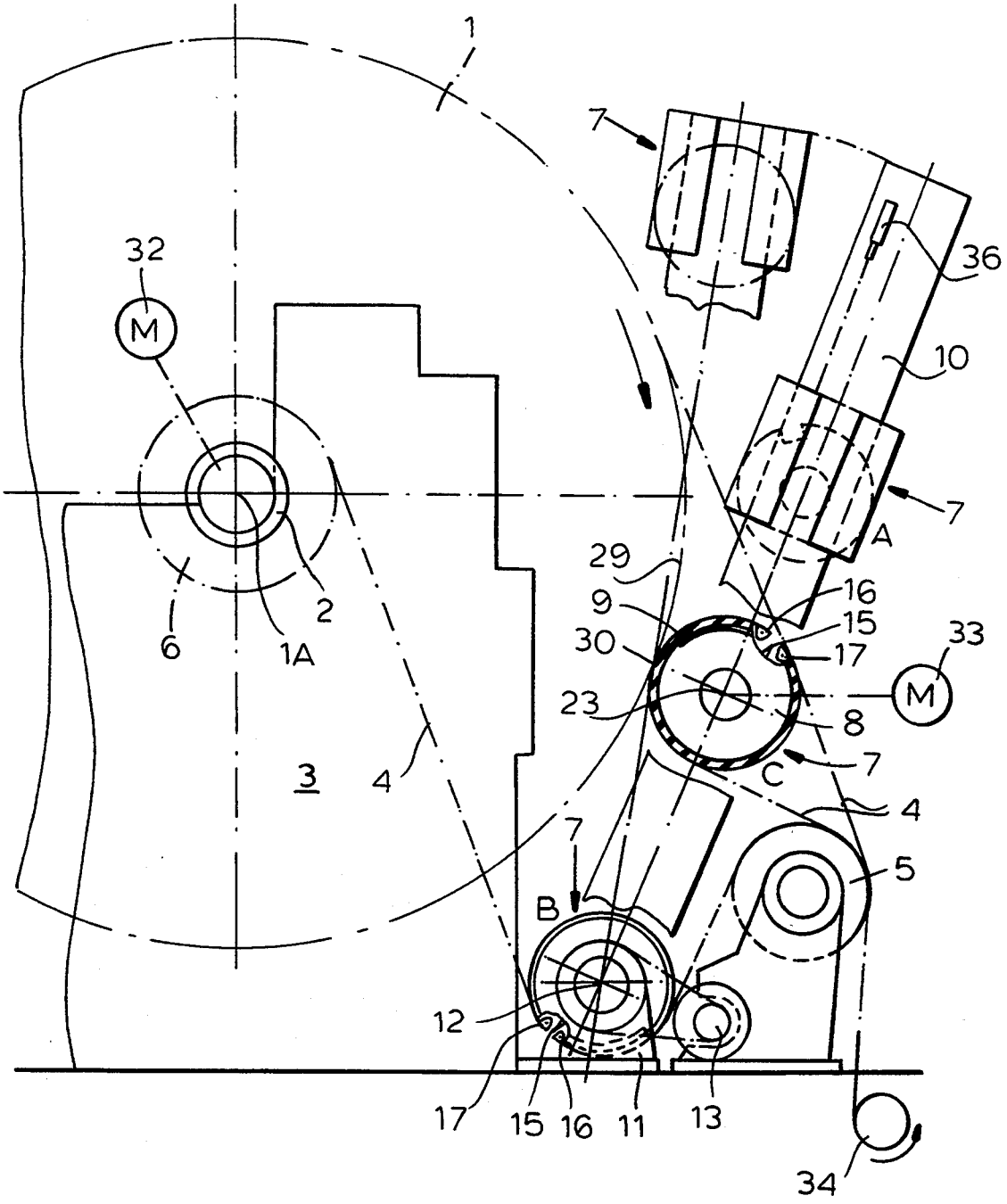
FIGS. 1 and 2 are partly diagrammatic end views of the unwinding/splicing system of this invention.

As seen in FIGS. 1 through 4, an unwinding/splicing system according to the invention and generally corresponding that of above-cited WO 90/10591 has a large-diameter paper roll 1 carried on a tambour or shaft 2 for rotation about a horizontal axis 1A in supports 3. A web 4 is pulled from this roll 1 over a deflecting roll 5 by an unwinding device indicated schematically at 34 until the big roll 1 has the small size indicated at dot-dash lines at 6.

A splicing apparatus 7 is comprised mainly of a cylindrical splicing drum 8 centered on a horizontal axis 23 and having an outer surface 9 covered with elastomeric material. This drum 8 is carried in arms 10 whose lower ends are supported in bearings 11 for pivoting about an axis 12 parallel to the axis 1A by means of a drive or actuator 13. Thus the drum 8 can be moved radially of the roll axis 1A and can also travel along the arms 10 tangentially of the supply roll 1 between the positions indicated at A, A', B, B', C, and C'.

Figure 2:
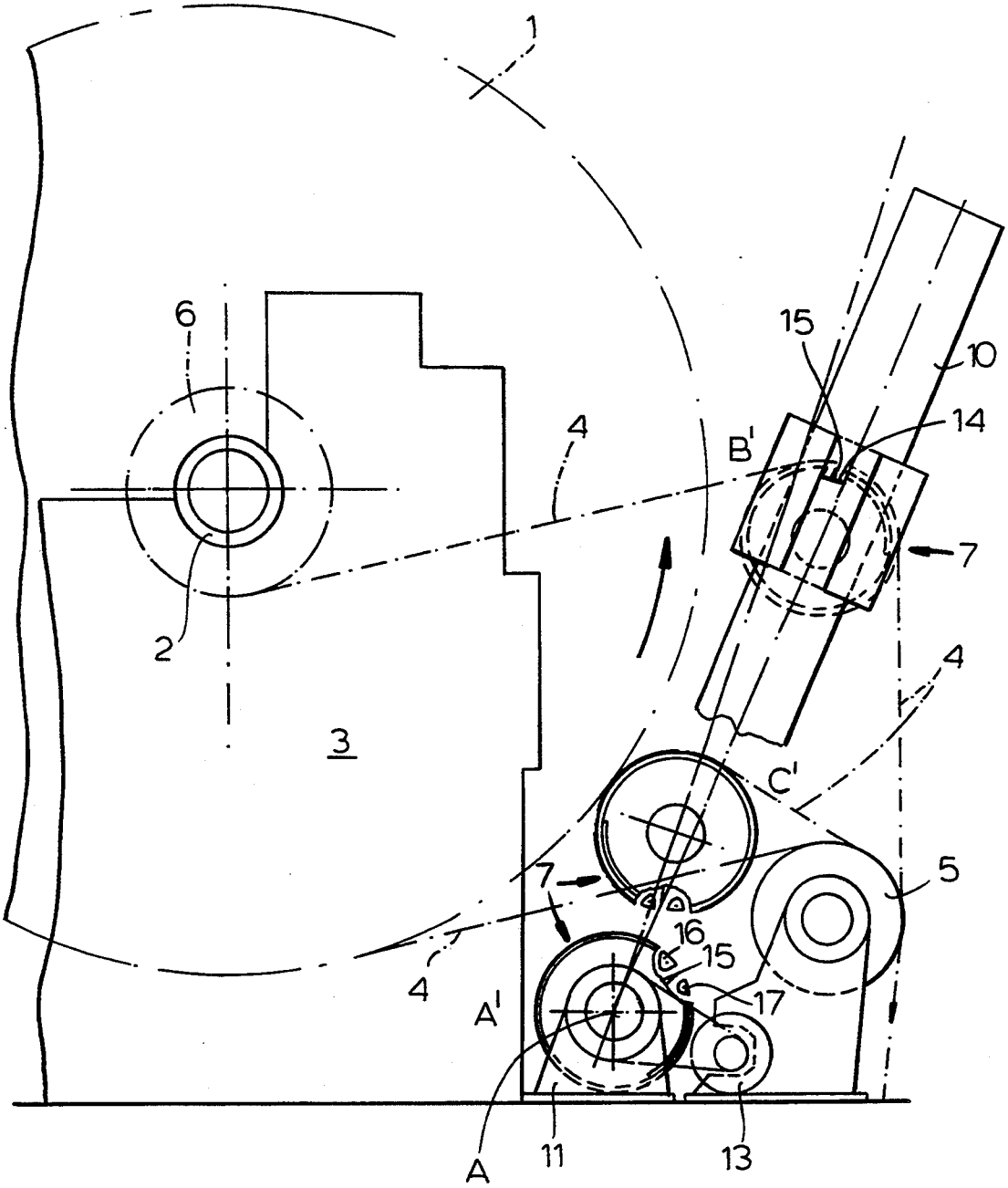

It is possible as seen by a comparison of FIGS. 1 and 2 for the roll 1 to be unwound clockwise with the outgoing web 4 moving basically downward (FIG. 1) or counterclockwise with the outgoing web 4 moving basically upward (FIG. 2) to the deflecting roll 5. The drum 8 itself can be rotated in either direction by a reversible variable-torque motor 33 can be moved by an actuator illustrated schematically at 36 to engage either upward or downward against the web 4, while the actuator 13 can press the drum 8 and any web 4 held by it against the roll 1.

Figure 3:
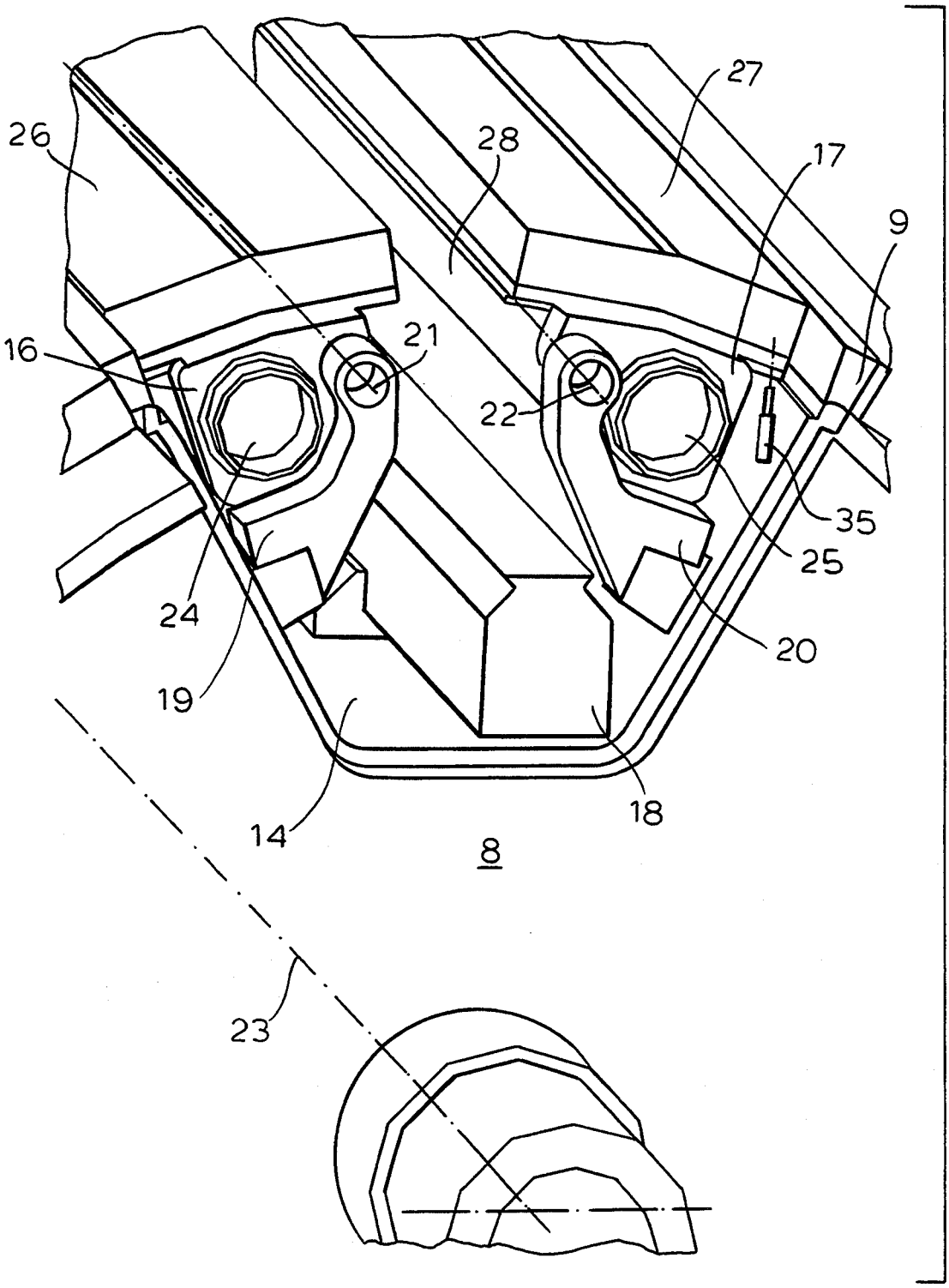
FIGS. 3 and 4 are partly diagrammatic perspective views of details of the splicing drum.
Figure 4:
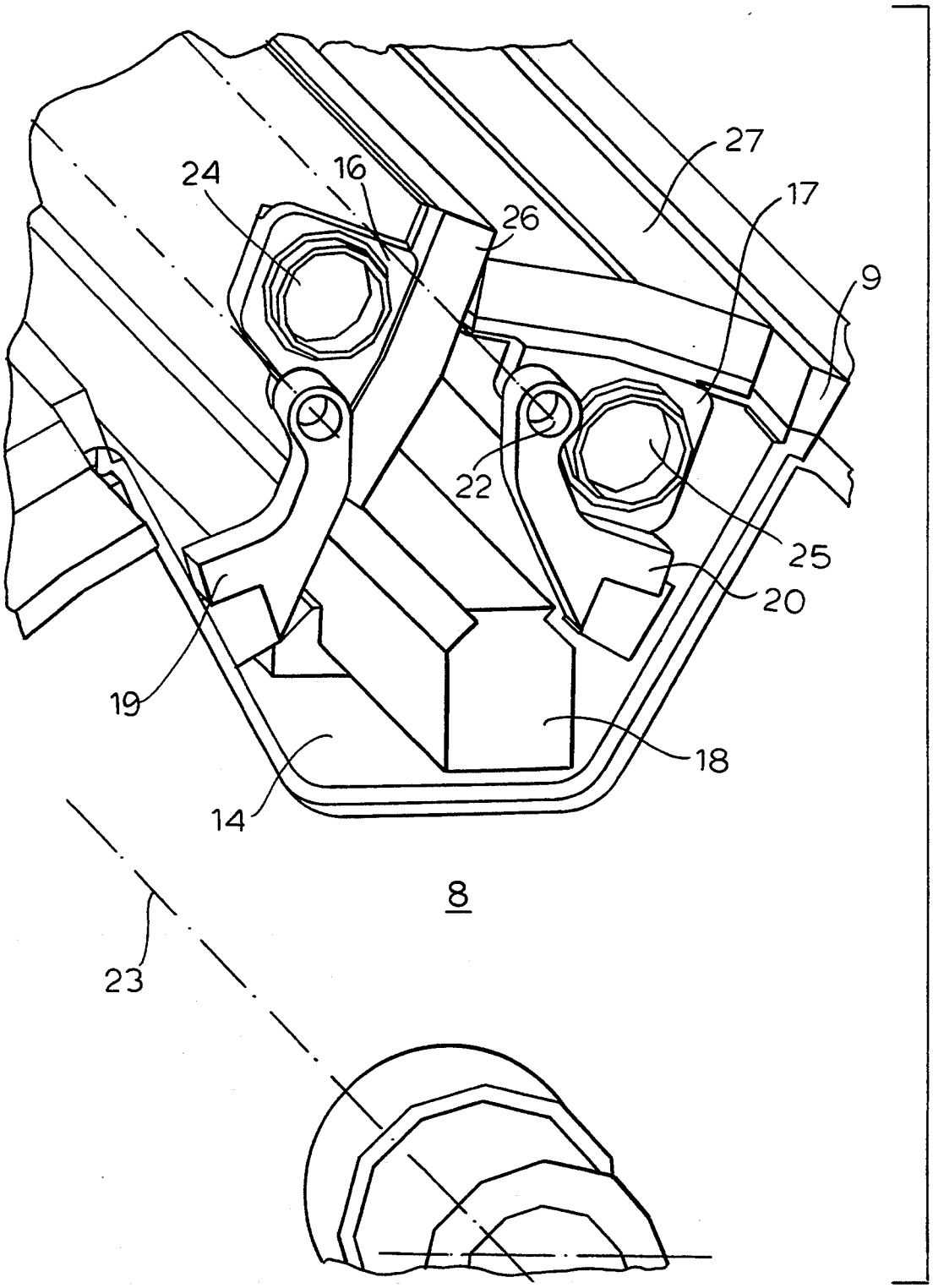

According to the invention as better seen in FIGS. 3 and 4 the drum 8 is formed with an axially throughgoing and radially outwardly open slot 14 defined between two axially extending suction bars 16 and 17 defining a gap 28 and having outer surfaces 26 and 27 that in the rest position of FIG. 3 form a smooth continuation of the cylindrical outer surface of the drum 8. A guide bar 18 extending along the base of the slot 14 supports a standard motorized cutter 15 (FIGS. 1 and 2) which can ride along the slot 14 to transversely slit a web 4 lying over the gap 28.

The bars 16 and 17 are each carried pivotally on a respective pair of arms 19 or 20 for pivoting about a respective axis 21 or 22 which extends parallel to the drum axis 23 but immediately radially within its outer surface. Actuators such as illustrated schematically at 35 in FIG. 3 can pivot each of the bars 16 and 17 between the rest positions shown for both bars 16 and 17 in FIG. 3 and for the bar 17 in FIG. 4 and the holding position shown for bar 16 in FIG. 4. In this holding position of FIG. 4, the outer face 26 of the bar 16 bears angularly against the edge of the bar 17. In addition the bars 16 and 17, which are hollow while their outer faces 26 and 27 are foraminous, slotted, or perforated, are provided with connectors 24 for connection to an unillustrated suction source.

As seen in FIG. 1, when the roll 1 has shrunk to the size of the roll 6 the drive 32 brakes and stops its rotation. Shortly before the web 4 stops the splicing apparatus 7 is moved from position A downward against the tensioned web 4 so that by the time it reaches position B the web 4 is spanned tightly over it, lying flatly on both bars 16 and 17 and bridging the gap 28. Suction applied via fitting 24 to the box 16 tightly adheres the web 4 to it so that the cutter 15 can transversely slit the web 4, making it possible to take out the depleted roll 6 and replace it with a full new roll 1 provided on its outer surface adjacent the free end of its web 4 with a strip 29 of pressure-sensitive adhesive. The drum 8 is then lifted and rotated clockwise by its drive 33, thereby maintaining tension constant in the web 4 downstream of where it is cut, that is between the drum 8 and the winding station/device 34.

The new roll 1 is set into the supports 3 with its glue strip 29 at a distance from a contact location 30 with the drum 8 that is smaller than the length of the piece of web 4 wound on the drum 8. Thus the drum 8 is pressed by the actuator 13 against the roll 1 at the location 30 (position C). At this time the suction in the bar 16 can be released and, in fact, the bar 16 can be pivoted back to its rest position so that the trailing end of the web 4 is held solely by the radial pressure of the drum 8 on the roll 1. The winder 34 is switched on so that the web 4 is payed out, thereby rotating the drum 8 and the roll 1 in contact with it. As the glue strip 29 is pressed against the trailing end of the web 4 pinched between the drum 8 and the roll 1, it attaches this trailing end to the leading end of the web wound on the roll 1. The splice is thus complete so that as the web 4 is pulled away it therefore pulls away the web 4 from the new roll 1.

If the web 4 is unwound oppositely in the counterclockwise direction as shown in FIG. 2, the sequence of steps for splicing is similar. The drum 8 is moved upward from position A' to position B' whereupon the other bar 17 is depressurized to adhere the web 4 in place. The web 4 is then transversely slit and the bar 17 is pivoted in to clamp the thus freed end. The drum 8 is rotated in the opposite direction to move into contact position C'.

FIGS. 5 through 10 show the steps during a change in takeoff direction, here when a clockwise-wound roll as in FIG. 1 is replaced with a counterclockwise-wound roll as in FIG. 2.

Figure 5:
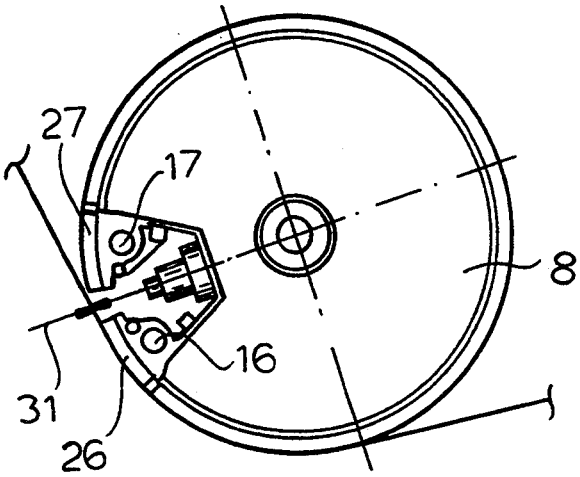
FIGS. 5 through 10 are small-section schematic end views illustrating operation of the system of this invention.
Figure 6:
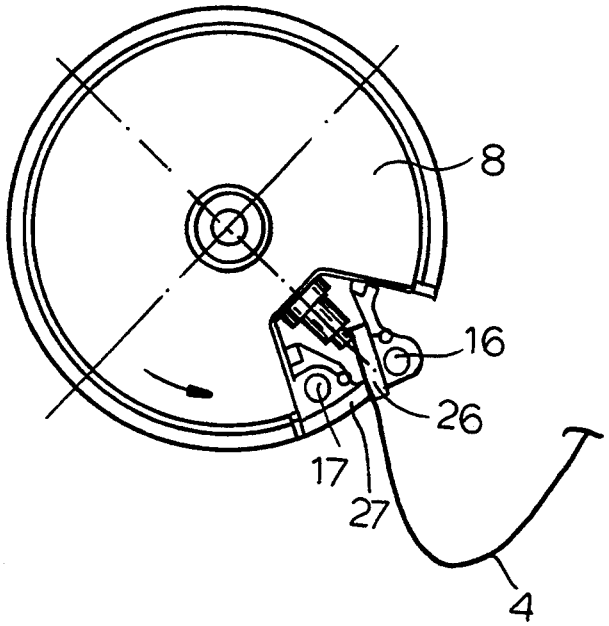

As seen in FIG. 5, starting with web withdrawal from the top of a clockwise-wound roll the front surface 26 of the bar 16 is engaged with the trailing end of the web 4 and the web 4 is cut across at 31. Then to put some slack in the web 4, the drum 8 is rotated counterclockwise as shown in FIG. 6 while the bar 16 is tipped in to clamp the cut trailing web end against the other bar 17. As soon as the web end is clamped between the bars 16 and 17, suction is stopped in the bar 16.

Figure 7:
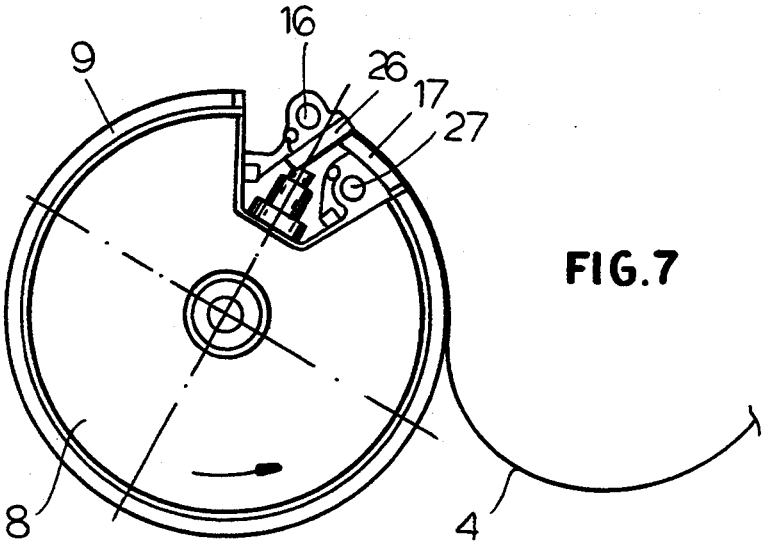
Figure 8:
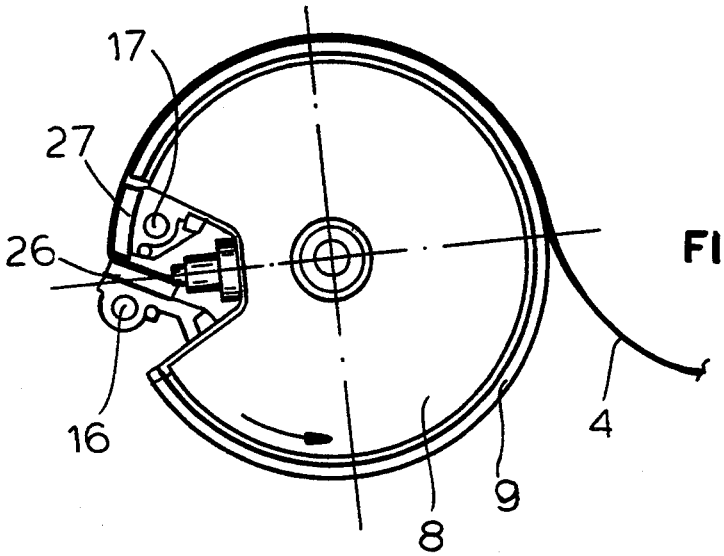
Figure 9:
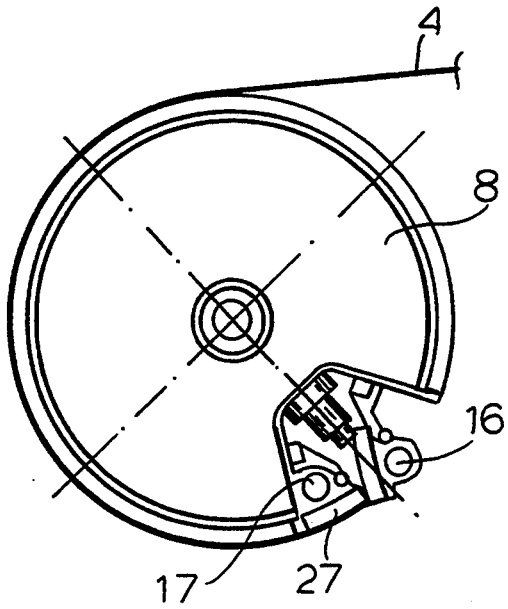

Further counterclockwise rotation of the drum 8 as seen in FIG. 7 reverses the lie of the web 4 on the surface 9 of the drum 8 until as seen in FIGS. 8 and 9 it is wound most of the way in the opposite direction around the drum 8, while meanwhile suction is started in the bar 17. In this FIG. 9 position it is possible for the drum 8 to exert considerable tension on the web 4 as the combination of the gripping of its end between the bars 16 and 17, the suction in the bar 17, and friction against the roller surface 9 holds the web 4 firmly.

Figure 10:
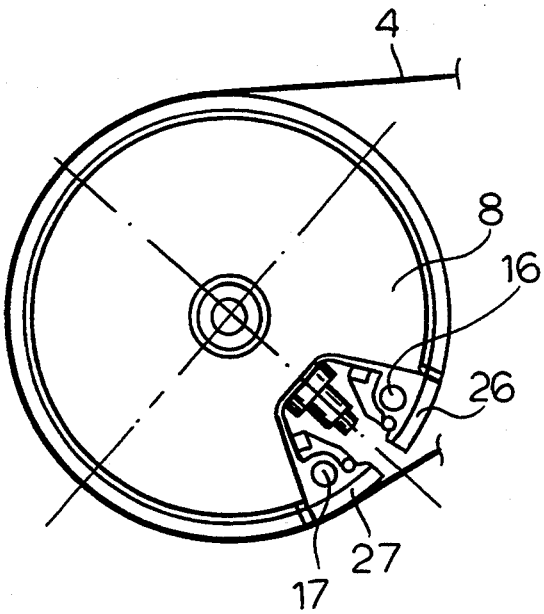

Finally as seen in FIG. 10 the bar 17 is tipped back to its starting position, whereupon the web 4 can be pressed against the new oppositely wound roll and a splice can be formed with a glue strip 29 as described above.

Clearly if the roll-wind direction changes oppositely, the steps described above are carried out, but with opposite rotation and using the bar 17 instead of the bar 16.

I claim:

1. In combination with:

a support for a roll of a web; and means for withdrawing the web from the roll and moving the web along a path as it is withdrawn from the roll, a splicing apparatus comprising:

a drum rotatable about a drum axis adjacent the roll and having a generally cylindrical outer surface centered on the drum axis;

a pair of suction bars on the drum defining thereon between them an axially extending and radially outwardly open slot, each bar having an outer surface and being pivotal about an axis generally parallel to the drum axis between a rest position with its surface forming a respective part of the outer surface of the drum and a holding position with its surface pressed angularly against the other bar, whereby in the holding position a web end can be clamped between the bars;

means for aspirating air through the surfaces of the bars and thereby adhering the web thereto; and control means connected to the drum for rotating same about the drum axis and for displacing the drum into engagement with the web.

2. The splicing apparatus defined in claim 1 further comprising a cutter displaceable along the slot between the bars for transversely slitting the web engaging the bar surfaces.

3. The splicing apparatus defined in claim 2 wherein the drum is provided in the slot with an axially extending guide rail on which the cutter rides.

4. The splicing apparatus defined in claim 1 wherein the axes of the bars are closely juxtaposed with the bar outer surface and are substantially offset from the drum axis.

5. The splicing apparatus defined in claim 1 wherein the control means includes a reversible variable-torque drive motor connected to the drum.

* * * * *